US006442972B1

(12) United States Patent
Watson

(10) Patent No.: US 6,442,972 B1
(45) Date of Patent: Sep. 3, 2002

(54) COLOR CODED CONCEPT FOR ARTICLES OF JEWELRY AND CLOTHING

(76) Inventor: James G. Watson, 9613 Haven Farm Ct., Unit G, Perry Hall, MD (US) 21128-9064

( * ) Notice: Subject to any disclaimer, the term of this patent is extended or adjusted under 35 U.S.C. 154(b) by 0 days.

(21) Appl. No.: 09/864,548

(22) Filed: May 24, 2001

(51) Int. Cl.[7] ..... A44C 25/00

(52) U.S. Cl. ..... 63/38; 63/3; 63/23; 63/26; 63/40

(58) Field of Search ..... 63/3, 23, 26, 38, 63/40

(56) References Cited

U.S. PATENT DOCUMENTS

| | | | | | |
|---|---|---|---|---|---|
| 1,829,880 | A | * | 11/1931 | Stockert | 63/38 |
| 1,894,195 | A | * | 1/1933 | Pulver | 63/28 |
| 2,138,596 | A | * | 11/1938 | Fassnacht | 63/23 |
| 3,176,836 | A | * | 4/1965 | Gunn | 206/575 |
| 3,204,343 | A | * | 9/1965 | Pollock | 434/195 |
| 3,269,032 | A | * | 8/1966 | Sumner | 434/95 |
| 3,483,716 | A | * | 12/1969 | Stenzler | 63/15 |
| 3,526,103 | A | * | 9/1970 | Lieber | 63/23 |
| 3,706,523 | A | * | 12/1972 | Kumm | 431/126 |
| 3,733,852 | A | * | 5/1973 | Johnson et al. | 63/37 |
| 4,022,318 | A | * | 5/1977 | Goodman | 206/223 |
| 4,430,869 | A | | 2/1984 | Zinni | 63/29 R |
| 4,879,882 | A | * | 11/1989 | Johnson et al. | 63/4 |
| 5,292,255 | A | * | 3/1994 | Goldwasser | 434/84 |
| 5,395,245 | A | * | 3/1995 | Heinz | 434/204 |
| 6,083,267 | A | * | 7/2000 | Motomiya et al. | 703/6 |

OTHER PUBLICATIONS

Shaw's Jeweler's Catalog page showing "Remebrance Jewelry".*

Gordon's Jeweler's Catalog p. 17 showing "Mothe's Rings".*

* cited by examiner

*Primary Examiner*—Jack Lavinder
*Assistant Examiner*—Andrea Chop
(74) *Attorney, Agent, or Firm*—Robert M. Gamson; Leonard Bloom

(57) ABSTRACT

An article of jewelry or clothing which includes, or has attached thereto, a plurality of colored components which have specific colors. Each specific color represents a numerical value. The colored components are arranged in a selected sequence to depict a desired number. A kit is disclosed to provide the colored components and to be used to attach the colored components to an item.

8 Claims, 4 Drawing Sheets

COLOR CODED CONCEPT FOR ARTICLES OF JEWELRY AND CLOTHING

BACKGROUND OF THE INVENTION

1. Field of the Invention

The present invention relates to the use of color codes representing numerical values and more particularly to the use of these color codes in a selected sequence on jewelry and clothing.

2. Description of Related Art

Color coding is a standard means of identification in countless public and private activities. The use of red, yellow and green for traffic lights is well known. Also, persons associated with electronics are familiar with the use of color codes to identify the ohmic value of resistors used in the electronic circuitry, such as a printed circuit board (PCB's). This color-coding scheme is at least fifty (50) years old.

However, the systematic use of colors to represent numerical values has not been extended to any other applications in the knowledge of the inventor. In today's society, numbers, with no color association, are a major method of providing identification. The majority of these number identifications are freely exchanged. Perhaps the most common are dates including birth dates, anniversary dates and other special occasion dates; telephone numbers, addresses and social security numbers.

Zinni in U.S. Pat. No. 4,430,869 discloses a jewelry ornament construction comprising an elongated pin and a plurality of ornamental elements. The elements are retained on the pin in a generally planar relation to form a composite ornament. The ornaments are adapted for personalization with various desired combinations of elements, which may embody monogramatic and emblematic insignia. Color coding is not disclosed.

It would be very helpful for persons to have a convenient and decorative media to display important numbers which affect their lives. The present invention provides such a helpful invention.

SUMMARY OF THE INVENTION

It is an object of the invention to provide a media which is convenient and aesthetic to display a sequence of numbers which are important to a person.

In accordance with the teachings of the present invention, there is disclosed an article of jewelry having a plurality of separate components. Each component has a specific color. Each specific color represents a numerical value wherein the components are arranged in a selected sequence.

In further accordance with the teaching of the present invention, there is disclosed an article of clothing having a plurality of color swatches formed thereon. Each color swatch has a specific color. Each specific color represents a numerical value wherein the color swatches are arranged in a selected sequence.

In still further accordance with the teachings of the present invention, there is disclosed a kit for decorating items. This kit has a plurality of members, each member having a front face and a back face. The front face of each member has a specific color thereon. Each specific color represents a numerical value. Means are provided on the back face of each member for attaching the respective member to the item wherein the members are arranged in a selected sequence.

In another aspect, there is disclosed a method of depicting a selected sequence of numerals. A plurality of colored components are provided, each color representing different numerical value ranging from 0 through 9 inclusively. Colored components are selected having a desired numerical value. The colored components are connected to an item in a selected sequence wherein the colors depict the selected sequence of numerals.

In still another aspect, there is disclosed the method of customizing an article of manufacture with an arrangement of colors selected by a purchaser of the article from a standard color-coded chart. The selected arrangement of colors represent a data or a number which is personally significant to the purchaser.

These and other objects of the present invention will become apparent from a reading of the following specification taken in conjunction with the enclosed drawings.

DESCRIPTION OF THE PREFERRED EMBODIMENTS

Figure 1A:
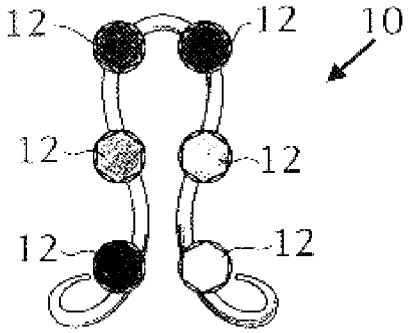
FIG. 1 is a perspective view of a broach showing a selected sequence of components, each having a specific color indicative of an anniversary date.

Referring now to FIG. 1, a broach is shown having gemstones of different colors in a selected sequence indicative of the anniversary date of Jan. 16, 1951 (i.e., Jan. 16, 1951). The color sequence is based on the following chart of color designations and numerical values:

0-Black
1-Brown
2-Red
3-Orange
4-Yellow
5-Green
6-Blue
7-Violet
8-Gray
9-White

In a broach 10 or other article of jewelry, the color components 12 may be, for example, precious gems, semi-precious gems, and non-gem components (such as colored beads, coral, enamel, metal) and/or mixtures of these components. The color components are not limited to the ones listed herein but may be any colored component known to persons skilled in the art which may be incorporated into jewelry. Viewed from bottom left clockwise to bottom right the gems are black, orange, red, blue, green and yellow having a numerical equivalent of 03 26 54 corresponding to the anniversary date of Mar. 26, 1954.

Figure 2A:
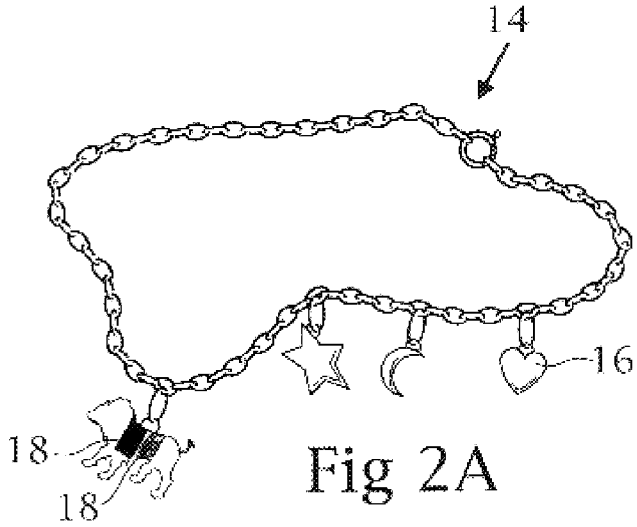
FIG. 2 is a perspective view of a bracelet with charms, one charm showing a selected sequence of components, each component having a specific color, the sequence being indicative of a month of the year.

FIG. 2 shows a bracelet 14 having a plurality of charms 16 dependent therefrom. One of the charms 16 has colored black and gray sections 18 thereon indicative of the number 08, which represent the month of August. Any combinations of colors to represent any selected month of the year which may correspond, for example, of a sign of the zodiac (as Leo in FIG. 2).

Figure 3A:
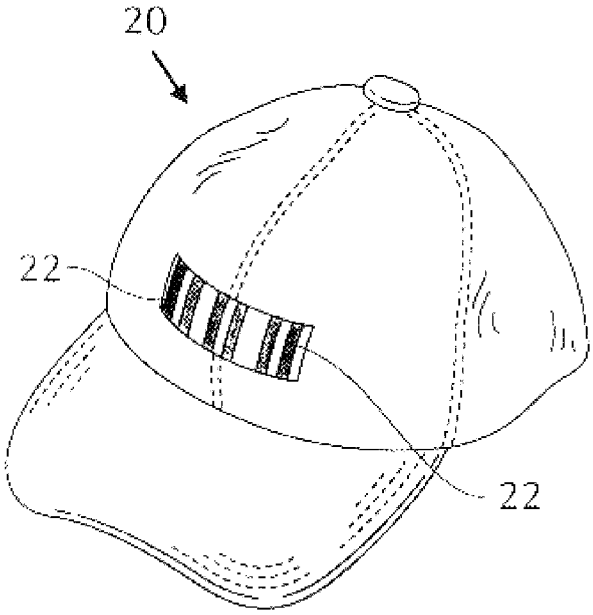
FIG. 3 is a perspective view of a baseball style cap having a selected sequence of swatches, each having a specific color indicative of a birthday date.

The present invention may also be used with clothing as shown in FIG. 3. A baseball style cap 20 has swatches 22 of cloth thereon which are black gray brown blue blue red having an equivalent numerical value of 01 16 62. These represent the birth date of Aug. 16, 1962.

Figure 4A:
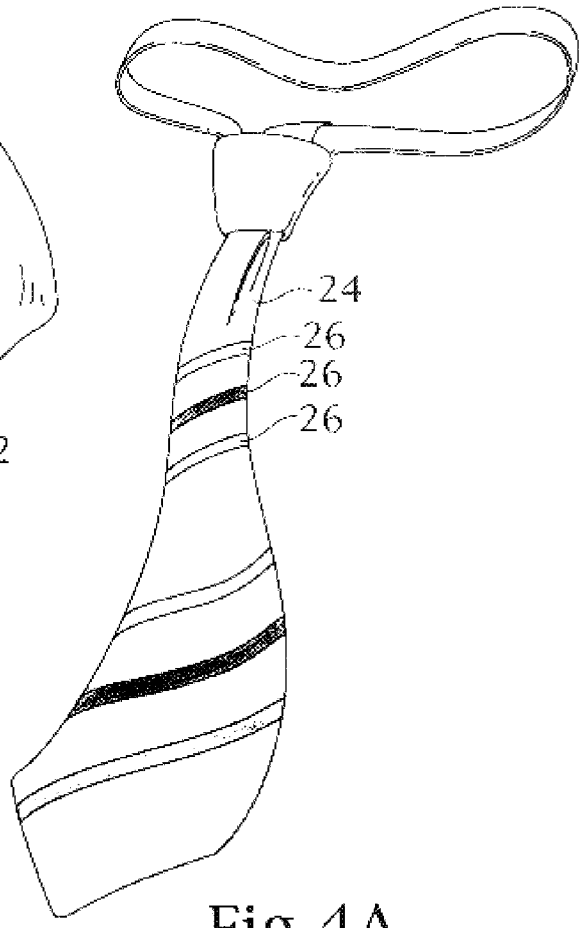
FIG. 4 is a perspective view of a necktie having a selected sequence of swatches, each having a specific color indicative of the hours of a workday.

An alternate use of the present invention on clothing are stripes 26 on a necktie 24 as shown in FIG. 4. In these figures, the stripes 26 are white, red and green (i.e., 9, 2, 5) representing the work hours of 9 AM to 5 PM.

Figure 5A:
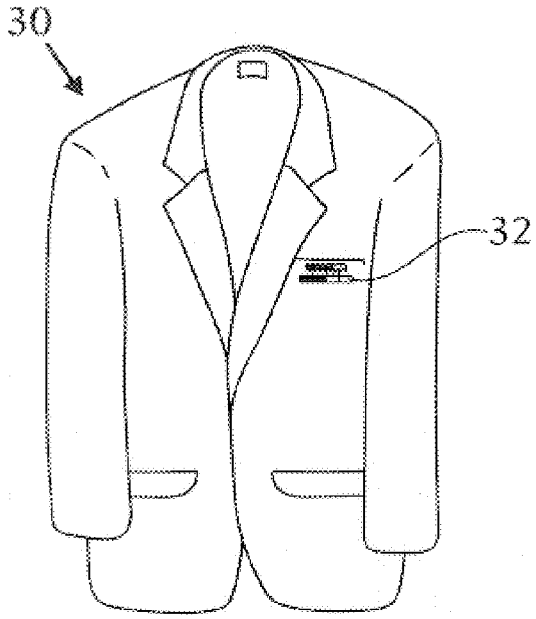
FIG. 5 is a perspective view of a man's blazer having a selected sequence of ribbons, each having a specific color indicative of a social security number.
Figure 6A:
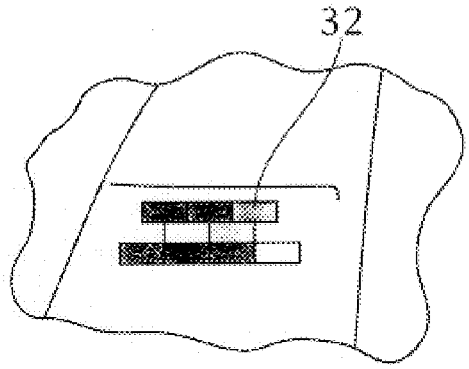
FIG. 6 is an enlarged view of FIG. 5.

A blazer jacket 30 shown in FIGS. 5, and 6 has brown, red, orange, yellow, green blue, violet, gray, white colored ribbons 32 attached thereto which represent a social security number (123 45 6789)

Figure 7A:
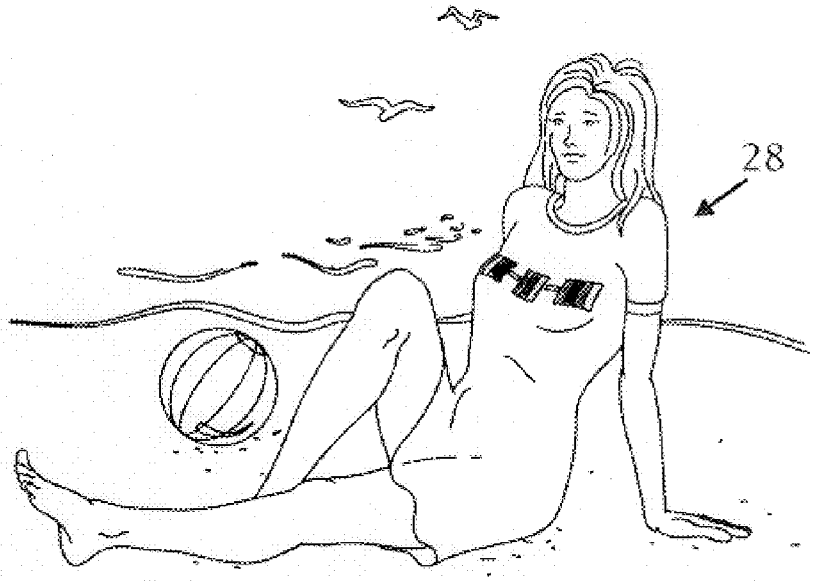
FIG. 7 is a perspective view of a person wearing a T-shirt having a selected sequence of swatches, each having a specific color indicative of a telephone number.

FIG. 7 shows the present invention on a T-shirt 28 displaying the telephone number 410 123 8765 (yellow, brown, black brown, red, orange, gray violet, blue, green) as an imprint.

The figures show typical uses of the present invention but are not all-inclusive. The present invention may be used in any manner known to persons skilled in the art. The color components may be formed from any material in or on which the color is present naturally, or by paint, dye, stain or tint. The color components my be natural or man-made. The color components maybe an integral part of the article bearing the color components or the color components may be connected or attached to the article.

Figure 8:
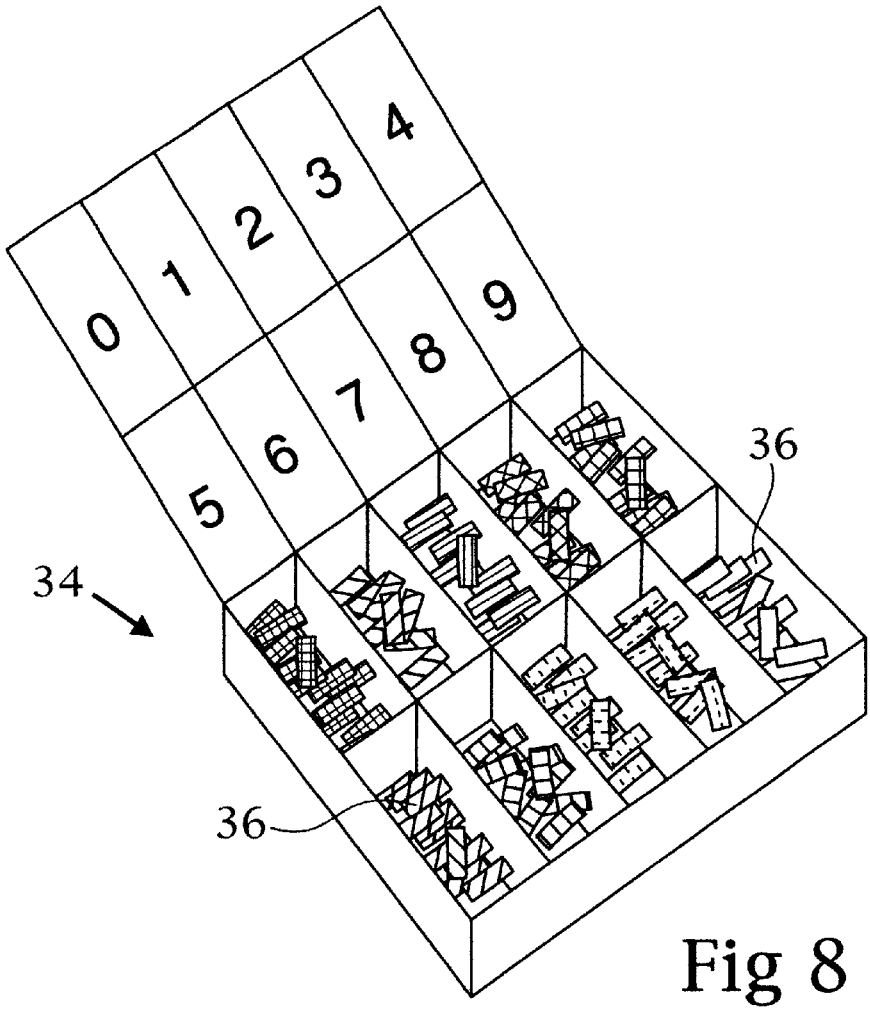
FIG. 8 is a perspective view of a kit having components, each compartment containing members having a specific color thereon.
Figure 9:
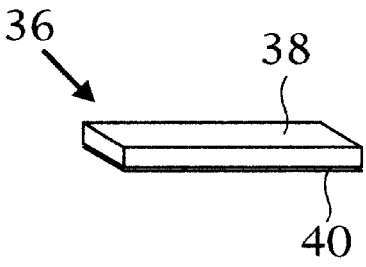
FIG. 9 is a perspective view of a component of the kit of FIG. 8.
Figure 10:
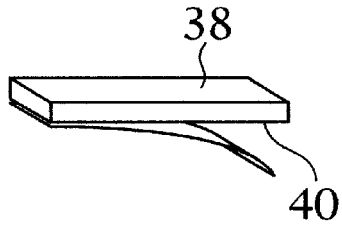
FIG. 10 is a perspective view of FIG. 8 showing removal of a protective cover over adhesive.
Figure 8A:
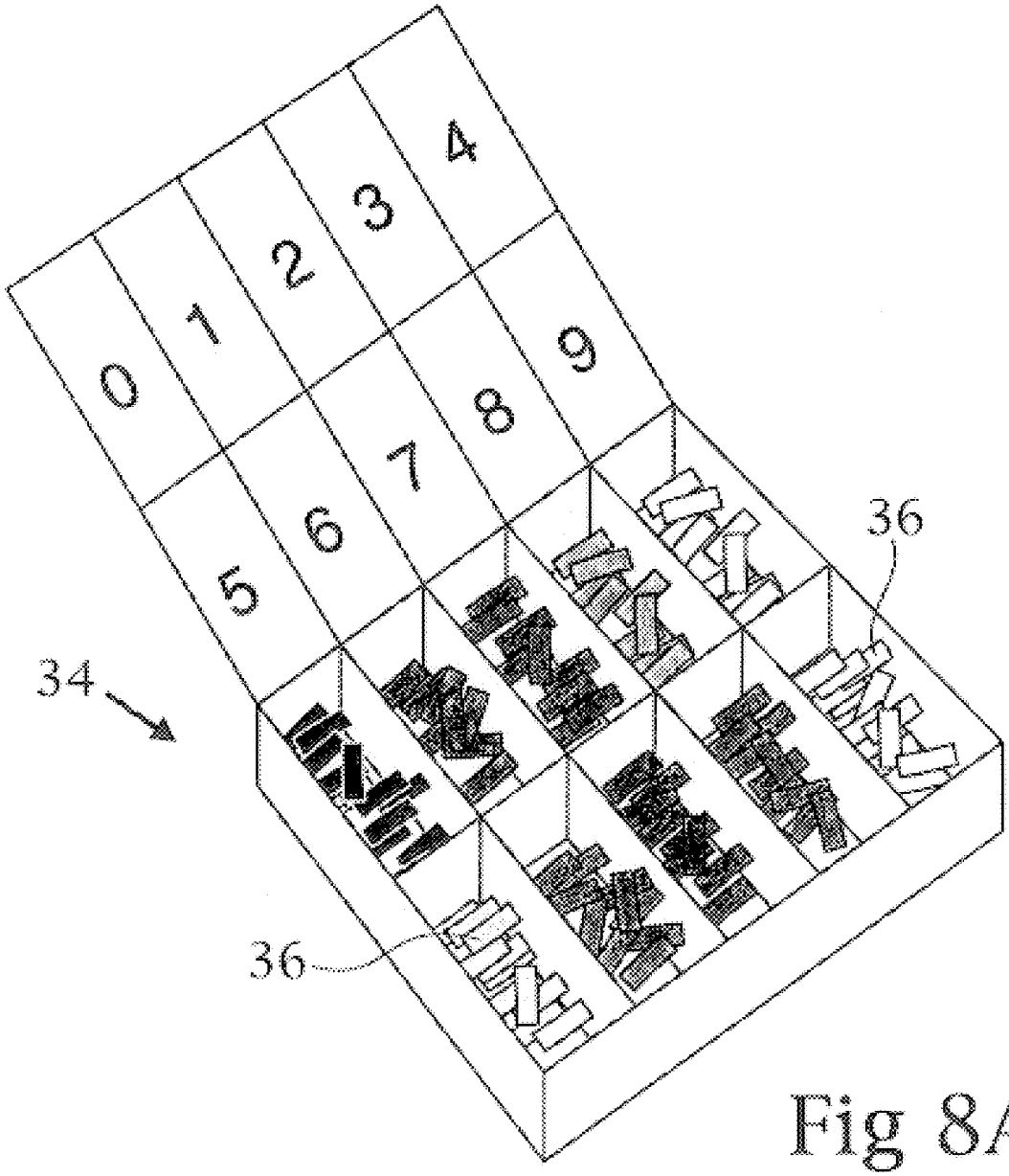

A kit 34 having a plurality of members 36 may be provided to apply the color members to any desired item in any selected sequence (FIG. 8) in order to customize the article. The kit 34 includes an indicator (shown on the lid in FIG. 8). Each member 36 has a front face 38 and a back face 40. The desired color is formed on the front face 38 and means are provided on the back face 40 to attach the respective member to the item (FIGS. 9–10). The means may be adhesive, magnets, clips, hook and loop fasteners or any means known to persons skilled in the art. The selected members may be removed from the kit, arranged in a desired sequence and attached to the item. The items may be an article of manufacture, for example a knickknack, a toy, an article of furniture, clothing, an automobile, a personal device such as a camera, mobile telephone, etc. The possibilities are limited only by the user's imagination and ingenuity.

For example, the invention may be merchandised at a kiosk in a mall, where articles of costume jewelry or clothing could be customized by a color-coded indicia selected by the purchaser to represent a date or number which is significant to that particular purchaser.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A method of assembling an article of jewelry comprising:

providing a plurality of elements, each element having a different color, providing an indicator, the indicator including indicia which functions to assign a numerical value to each color, and assembling the elements in a selected sequence to form an article of jewelry using the indicator as a reference, the sequence having particular significance for a person who is the intended wearer of the article of jewelry.

2. The method of claim 1, wherein the numerical value and the corresponding colors are as follows:

0-Black
1-Brown
2-Red
3-Orange
4-Yellow
5-Green
6-Blue
7-Violet
8-Gray
9-White.

3. The method of claim 1, wherein the selected sequence identifies a member selected from the group consisting of dates, telephone numbers, social security numbers, and addresses.

4. The method of claim 1, wherein the elements are selected from the group consisting of precious gems, semi-precious gems, non-gems, beads, corals, enamels, and mixtures thereof.

5. A kit for jewelry comprising a plurality of jewelry elements, each jewelry element having a different color, the kit further comprising an indicator, the indicator including indicia which functions to assign a numerical value to each color, the jewelry elements being adapted to be selected and assembled in a desired sequence using the indicator as a reference to form an article of jewelry intended to be worn by a person, wherein the desired sequence has a particular significance for the person wearing the article.

6. The kit of claim 5, wherein the numerical value and the corresponding colors are as follows:

0-Black
1-Brown
2-Red
3-Orange
4-Yellow
5-Green
6-Blue
7-Violet
8-Gray
9-White.

7. The kit of claim 5, wherein the selected sequence identifies are element selected from the group consisting of dates, telephone numbers, social security numbers, and addresses.

8. The kit of claim 5, wherein the elements are selected from the group consisting of precious gems, semi-precious gems, non-gems, beads, corals, enamels, and mixtures thereof.

* * * * *

UNITED STATES PATENT AND TRADEMARK OFFICE

CERTIFICATE OF CORRECTION

PATENT NO. : 6,442,972 B1
DATED : September 3, 2002
INVENTOR(S) : James G. Watson It is certified that error appears in the above-identified patent and that said Letters Patent is hereby corrected as shown below:

Column 1,
Lines 53-54, "(i.e., Jan. 16, 1951)" should read -- (i.e., 1/16/51) --.

Signed and Sealed this

Tenth Day of June, 2003

JAMES E. ROGAN
*Director of the United States Patent and Trademark Office*